US006853825B2

(12) United States Patent
Suzuki et al.

(10) Patent No.: US 6,853,825 B2
(45) Date of Patent: Feb. 8, 2005

(54) IMAGE FORMING APPARATUS INCLUDING IMAGE TRANSPORTING BELT AND ROTARY ROLL

(75) Inventors: Wataru Suzuki, Kanagawa (JP); Atsuyuki Kitamura, Kanagawa (JP); Shinichi Kuramoto, Kanagawa (JP); Masahiro Sato, Kanagawa (JP); Mitsuo Yamamoto, Kanagawa (JP); Koichi Watanabe, Kanagawa (JP); Shuichi Nishide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/383,597

(22) Filed: Mar. 10, 2003

(65) Prior Publication Data

US 2003/0190173 A1 Oct. 9, 2003

(30) Foreign Application Priority Data

Mar. 18, 2002 (JP) ..... 2002-073975
Jun. 26, 2002 (JP) ..... 2002-186559

(51) Int. Cl.[7] ..... G03O 15/00
(52) U.S. Cl. ..... 399/167; 399/302
(58) Field of Search ..... 399/162–165, 399/167, 297, 298, 302, 303, 313, 66, 121

(56) References Cited

U.S. PATENT DOCUMENTS 6,553,203 B2 * 4/2003 Van Weverberg ..... 399/302

FOREIGN PATENT DOCUMENTS

JP 11-52757 2/1999

* cited by examiner

*Primary Examiner*—William J. Royer
(74) *Attorney, Agent, or Firm*—Oliff & Berridge, PLC

(57) ABSTRACT

In an image forming apparatus provided with an image transporting belt that holds an image directly or indirectly and is laid on a plurality of tension rolls thereby to move circularly, and a sub-unit having a rotary roll that comes into contact with this image transporting belt and is rotationally driven by a drive section, the drive section includes a drive source, and an elastic drive power transmitting member that transmits drive power from the drive source and absorbs difference in peripheral speed produced between the image transporting belt and the rotary roll. The drive section includes a slip transmission member that engages with the elastic drive power transmitting member and slips under a condition over a peripheral speed difference absorbable range of the elastic drive power transmitting member.

16 Claims, 12 Drawing Sheets

IMAGE FORMING APPARATUS INCLUDING IMAGE TRANSPORTING BELT AND ROTARY ROLL

The present disclosure relates to the subject matter contained in Japanese Patent Application No. 2002-073975 filed Mar. 18, 2002 and Japanese Patent Application No. 2002-186599 filed Jun. 26, 2002, which are incorporated herein by reference in their entirety.

BACKGROUND OF THE INVENTION

1. Field of the Invention

The present invention relates to an image forming apparatus such as a copying machine and a printer, and particularly to an image forming apparatus which uses an image transporting belt that holds an image directly or indirectly and moves circularly.

2. Description of the Related Art

Conventionally, as this type of image forming apparatus, there is an intermediate transfer type of image forming apparatus that adopts an electrophotographic system. In this image forming apparatus, a toner image of each color component (for example, Y (yellow), M (magenta), C (cyan), and K (black)) is formed on an image holding member such as a photoconductor drum, and these toner images are temporarily multilayer-transferred on the same part on an intermediate transfer matter (first transfer). Thereafter, this multilayered toner image is transferred on a paper sheet in the lump (second transfer), and next the toner remaining on the intermediate transfer matter is removed by a cleaning device.

As this type of intermediate transfer matter, a belt-like matter is frequently used because it is high in freedom of layout in the apparatus and it is small in occupancy area.

In the mode using this type of intermediate transfer belt, the intermediate transfer belt is laid on a plurality of tension rolls in a tensed state, moves circularly, and transports the multilayer-transferred toner image. However, in case that the velocity of the intermediate transfer belt varies, position errors of the layered toner images of the respective color components are produced, so that a color registration error occurs on the sheet, which causes a technical problem that quality of image lowers.

Due to pressure-contact of a second transfer roll with the intermediate transfer belt in the above image forming cycle, and passing of the sheet between the intermediate transfer belt and the second transfer roll, such the technical problem is caused. Namely, when the second transfer roll is brought into pressure contact with the intermediate transfer belt in order to secondarily transfer the multilayered toner image primarily transferred on the same portion on the intermediate transfer belt, a variation load is applied onto the intermediate transfer belt. Further, a driving load applied on the tension roll to which the drive power is transmitted from the drive source increases, the moving speed of the intermediate transfer belt and the speed of the drive source vary, and elongation of the intermediate transfer belt and strain in the intermediate transfer belt surface are produced by tensile stress acting between the pressure-contact portion and the driving portion.

In order to solve such the technical problems, conventionally a method has been already known (for example, JP-A-11-52757), in which a rotary drive source is provided for a second transfer roll, these are connected through a torque limiter to each other, and the second transfer roll is driven so that its surface speed becomes higher than the surface speed of an intermediate transfer belt, whereby the variation load produced in the intermediate transfer belt is reduced and running performance of the intermediate transfer belt is stabilized.

However, in this method, the variation load in the direction along which the moving speed is accelerated is produced in the intermediate transfer belt, which gives an influence on the moving speed of the intermediate transfer belt.

Further, though the elongation of the intermediate transfer belt by tension power can be prevented, to the contrary, the intermediate transfer belt can change in the contractible direction. particularly, in case where a material that is small in Young's modulus is used in the intermediate transfer belt, the above influence is larger.

Further, in this method, since the torque limiter is necessary for drive torque transmission of the second transfer roll, the structure becomes complicated, and cost becomes high.

The above technical problems are not limited to the intermediate transfer belt but are produced also in belt-like members such as a photoconductor belt and a sheet transporting belt which hold an image directly or indirectly thereon and transport it.

SUMMARY OF THE INVENTION

The invention has been made in order to solve the above technical problems, and its object is to provide an image forming apparatus in which a load applied onto an image transporting belt due to the peripheral speed difference is reduced, stable running performance of the image transporting belt is secured and accuracy of color multilayer is good.

According to a first aspect of the invention, there is provided an image forming apparatus comprising: an image transporting belt that holds an image directly or indirectly and is laid on a plurality of tension rolls to move circularly; and a sub-unit having a rotary roll that comes into contact with the image transporting belt and a drive section for rotationally driving the rotary roll, wherein the drive section includes a drive source, and an elastic drive power transmitting member that transmits drive power from the drive source and absorbs difference in peripheral speed produced between the image transporting belt and the rotary roll.

According to a second aspect of the invention, there is provided an image forming apparatus comprising: an image transporting belt that holds an image directly or indirectly and is laid on a plurality of tension rolls to move circularly; and a sub-unit having a rotary roll that comes into contact with the image transporting belt and a drive section for rotationally driving the rotary roll, wherein the drive section includes a drive source, an elastic drive power transmitting member that transmits drive power from the drive source and absorbs peripheral speed difference produced between the image transporting belt and the rotary roll, and a slip transmission member that engages with the elastic drive power transmitting member and slips under a condition over a peripheral speed difference absorbable range of the elastic drive power transmitting member.

DESCRIPTION OF THE INVENTION

Figure 1:
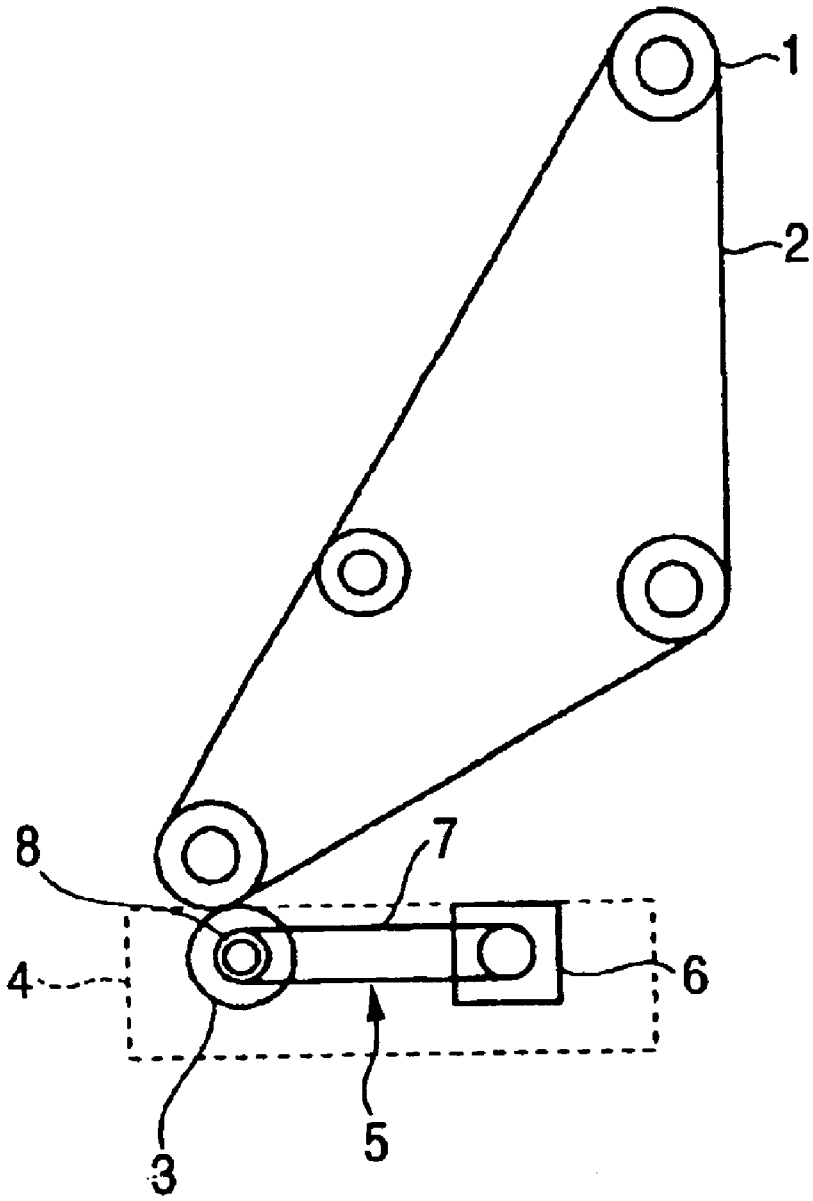
FIG. 1 is an explanatory view showing an outline of a drive section of an image forming apparatus according to one embodiment of the invention.

As shown in FIG. 1, an image forming apparatus is provided with an image transporting belt 2 that holds an image directly or indirectly and is laid on a plurality of tension rolls 1 to move circularly, and a sub-unit 4 having a rotary roll 3 that comes into contact with this image transporting belt 2 and is rotationally driven by a drive section 5, the drive section 5 includes a drive source 6, and an elastic drive power transmitting member 7 that transmits drive power from the drive source 6 and absorbs difference in peripheral speed produced between the image transporting belt 2 and the rotary roll 3.

In such the technical aspect, as long as the image transporting belt 2 holds an image directly or indirectly thereon and is laid on a plurality of tension rolls 1 to move circularly, it may be, for example, an intermediate transfer belt. However, the image transporting belt 2 is not limited to this, but may be a photoconductor belt or a sheet transporting belt.

Further, the sub-unit 4 has the rotary roll 3 that comes into contact with the image transporting belt 2 and is rotationally driven by the drive section 5. Here, a second transfer roll and a cleaning roll are used as the rotary roll 3, a tension roll, a drive roll, and a photoconductor drum are not used though they are in the shape of a roll.

Further, the drive section 5 includes the drive source 6 for giving drive power to the rotary roll 3, and the elastic drive power transmitting member 7 that transmits drive power from the drive source 6 and absorbs peripheral speed difference produced between the image transporting belt 2 and the rotary roll 3.

Here, the elastic drive power transmitting member 7 is made of an elastic member, which not only transmits the rotary power to the rotary roll 3 but itself also expands and contracts before the image transporting belt 2 expands and contracts by changing the moving speed of the image transporting belt 2 due to contact of the rotary roll 3 with the image transporting belt 2 thereby to absorb difference in peripheral speed produced between the both.

In such the technical aspect, it is preferable that the elastic drive power transmitting member 7 is larger in tensile strain than the image transporting belt 2. As long as the elastic drive power transmitting member 7 is larger in tensile strain than the image transporting belt 2, it more readily expands and contracts than the image transporting belt 2. Therefore, the difference in peripheral speed is absorbed, and stable running performance of the image transporting belt 2 can be secured.

Further, it is preferable that the drive section 5 includes, in addition to the drive source 6 and the elastic drive power transmitting member 7, a slip transmission member 8 that engages with the elastic drive power transmitting member 7 and slips under a condition over a peripheral speed difference absorbable range of the elastic drive power transmitting member 7.

In case the peripheral speed difference produced between the image transporting belt 2 and the rotary roll 3 is stored, the expansion and contraction of the elastic drive power transmitting member 7 comes to a maximum, and the elastic drive power transmitting member 7 can not absorb the peripheral speed difference, the slip transmission member 8 comes into contact with the elastic drive power transmitting member 7 and slips thereby to reduce a factor of speed variation given to the image transporting belt 2. As the slip transmission member 8, there is, for example, a pulley.

Accordingly, in the mode where the drive section 5 includes both of the elastic drive power transmitting member 7 and the slip transmission member 8, the periodical speed variation factor in the peripheral speed difference produced between the image transporting belt 2 and the rotary roll 3 is absorbed by elasticity of the elastic drive power transmitting member 7, and the speed variation produced by storing of the peripheral speed difference in the elastic drive power transmitting member 7 is suppressed by the slip generated by the slip transmission member 8. In result, the speed variation given to the image transporting belt 2 can be prevented.

Figure 2:
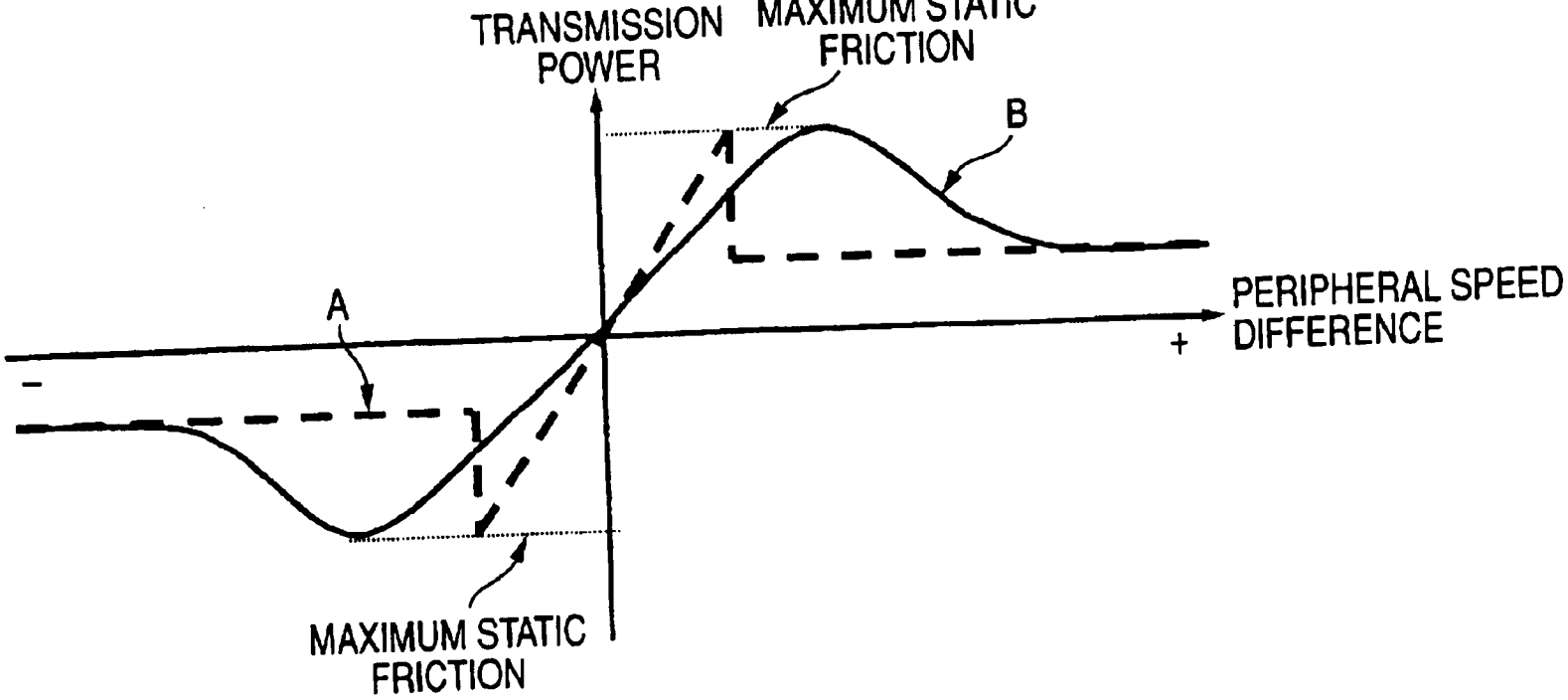
FIG. 2 is a graph diagram showing comparison between a mode using a slip transmission system and a mode using an elastic transmission system and the slip transmission system.

Namely, as shown in FIG. 2, in case that a mode (dotted line A in FIG. 2) in which the peripheral speed difference produced between the image transporting belt 2 and the rotary roll 3 is suppressed without having the elastic drive power transmitting member 7 by using only a torque limiter as a slip transmission system is compared with a mode (solid line B in FIG. 2) in which the peripheral speed difference is suppressed by using both of an elastic transmission system and the slip transmission system. In a range where the peripheral speed difference is from zero to a maximum static friction, change of the transmission power at the peripheral speed difference varying time is gentler in the mode (solid line B) having both elastic transmission system and slip transmission system than in the mode (dotted line A) having only the slip transmission system, and a load variation given to the image transporting belt 2 becomes gentle.

Further, in a moment when the peripheral speed difference exceeds the maximum static friction, in the mode (dotted line A) having only the slip transmission system, change of the friction when the peripheral speed difference exceeds the maximum static friction and moves to dynamical friction occurs sharply. On the other hand, in the mode (solid line B) having both the elastic transmission system and slip transmission system, since the change of the transmission power at the peripheral speed difference varying time becomes gentle, the load variation given to the image transporting belt 2 becomes gentle.

Further, it is preferable that the drive source 6 of the drive section 5 is the same as a drive source that moves circularly the image transporting belt 2. By using the same drive source, the speed variation component due to the drive source can be canceled. Compared with a mode where the drive sources are provided respectively for the image transporting belt 2 and the rotary roll 3, the peripheral speed difference produced between both of them can be suppressed.

Further, it is preferable that the elastic drive power transmitting member 7 is driven by the tension roll 1 (drive roll 1) of the image transporting belt 2. For example, there is a mode in which a pulley having the same outer diameter as the drive roll 1 is provided at an end of the rotary roll 3, the elastic drive power transmitting member 7 is laid on this pulley and the drive roll 1 of the image transporting belt 2, and the drive power is transmitted from the drive source of the image transporting belt 2 through the drive roll 1 and the elastic drive power transmitting member 7 to the rotary roll 3, whereby the rotary roll 3 is rotated.

According to this mode, since the rotary roll 3 can obtain the drive power from the drive roll 1 that drives directly the image transporting belt 2, the peripheral speed of the rotary roll 3 can be accurately fitted to that of the image transporting belt 2.

Therefore, the peripheral speed of the rotary roll 3 becomes approximately the same as that of the image transporting belt 2, so that the influence of the variation load onto the image transporting belt 2, which is caused by the difference in peripheral speed, can be suppressed.

Further, the variation load acts on the image transporting belt 2 means a load that obstructs running of the image transporting belt 2 and varies.

Furthermore, it is preferable that a tracking portion that performs positioning to the image transporting belt 2 is provided for a part of the rotary roll 3. For example, there is a mode in which a tracking roll that is coaxial with the rotary roll 3, slightly smaller in diameter than the rotary roll 3, and formed integrally with the rotary roll 3 is used, the elastic drive power transmitting member 7 is laid on the tracking roll and the drive roll 1 of the image transporting belt 2, and the rotary roll 3 rotates by the drive power transmitted through the drive roll 1 and the elastic drive power transmitting member 7 from the drive source of the image transporting belt 2.

According to this mode, since the tracking roll and the rotary roll 3 are formed integrally, compared with the mode using the pulley, the rotation driving power is directly transmitted to the rotary roll 3, so that rotational accuracy improves.

Further, it is preferable that the image transporting belt 2 is composed of an elastic member. By the image transporting belt 2 composed of the elastic member, there is little walk motion, and the tension mechanism is not required. Further, contact surface pressure between the photoconductor drum and the intermediate transfer belt can be lowered, so that an image defect such as a hollow character can be effectively suppressed.

Here, though it is effective from the above viewpoint that the image transporting belt 2 is composed of the elastic member, the expansion and contraction of the image transporting belt 2 due to the variation load becomes large, and correspondingly the color registration error is easy to be produced.

However, according to the invention, it is possible to suppress the variation load onto the image transporting belt 2 to the minimum. Therefore, in case that the image transporting belt 2 is composed of the elastic member, an effect of the invention appears remarkably.

Further, it is preferable that the image transporting belt 2 comes into contact with a drum-shaped image holding member and is arranged along its shape.

According to this mode, by arranging the image transporting belt 2 (for example, intermediate transfer belt) along the shape of the drum-shaped image holding member (for example, photoconductor drum) as much as possible, discharge due to useless space before and after a nip region at the transfer time is eliminated, and dispersion of the toner image can be prevented.

Further, in case that a belt made of hard resin is used as the intermediate transfer belt 2, press against the photoconductor drum is so high that a hollow defect of the toner image is produced. Therefore, in this mode, the elastic material is used, and closeness between the intermediate transfer belt 2 and the photoconductor drum must be raised with low contact pressure.

Further, in a mode in which the intermediate transfer belt 2 is driven and rotated in accordance with the photoconductor drum, enlarging the contact area between them makes adoption of this mode easy, and correspondingly disturbance in image due to drive interference between them can be prevented.

In such the technical aspect,in the mode in which the drive section 5 has the drive source 6, the elastic drive power transmitting member 7 and the slip transmission member 8, it is preferable that the elastic drive power transmitting member 7 is an endless belt having an approximately circular section, and a radius of curvature of a section of a fitting portion of the slip transmission member 8 to the elastic drive power transmitting member 7 is larger than a radius of curvature of a section of the elastic drive power transmitting member 7. By making the section of the elastic drive power transmitting member 7 approximately circular, in the fitting surface of them, the contact area with the slip transmission member 8 becomes small, so that a slip is easy to be produced.

Further, it is preferable that a fitting surface between the elastic drive power transmitting member 7 and the slip transmission member 8 is approximately plain, and either of them is concave and convex in the longitudinal direction. Though the elastic drive power transmitting member 7 has limitations in belt width of the elastic drive power transmitting member 7 (for example, elastic drive power transmitting belt) and degree of its tension according to size of the slip transmission member 8 and degree of the peripheral speed difference, the contact area between them can be adjusted in such the mode, so that the amount of slip can be adjusted.

Here, as long as the fitting surface between the elastic drive power transmitting member 7 and the slip transmission member 8 is approximately plain, they may be so designed appropriately that the elastic drive power transmitting member 7 is composed of a flat belt and grooves are provided over the surface of the slip transmission member 8 (for example, pulley) thereby to provide an uneven shape, or that grooves are provided over the surface of the elastic drive power transmitting member 7 thereby to provide an uneven shape and the slip transmission member 8 is composed of a general pulley.

Further, the slip transmission member 8 is attached to at least one of the drive source 6 and the rotary roll 3.

Particularly, in case that the slip transmission member 8 is attached to at least a rotary shaft of the rotary roll 3, of the drive source 6 and the rotary roll 3, it is preferable that the slip transmission member 8 rotates integrally with the rotary roll 3. By the integral rotation of the slip transmission member 8 with the rotary roll 3, the drive power of the drive source 6 is directly transmitted, and rotary accuracy of the rotary roll 3 improves.

Further, it is preferable that the slip transmission member 8 is used also as a component member of the rotary roll 3. According to this mode, the rotary shaft of the rotary roll 3 itself works as the slip transmission member 8 (for example, pulley). Therefore, the slip transmission member 8 as an individual member is not required.

Further, in such the technical aspect, it is preferable that components of the drive section 5 are incorporated into the sub-unit 4, and the sub-unit 4 is detachably attached to the image forming apparatus body. By detachably attaching the sub-unit 4 to the image forming apparatus body, the sub-unit 4 including the rotary roll 3 can be detached together with the rotary roll 3 from the image forming apparatus body. Therefore, when the rotary roll 3 is exchanged because of its life, the rotary roll 3 is detached from the sub-unit 4 at a wide space outside the apparatus, so that the rotary roll 3 is easily exchanged.

Further, it is preferable that the rotary roll 3 of the sub-unit 4 is provided separably from the image transporting belt 2. Hereby, when the rotary roll 3 separates from the image transporting belt 2, elastic deformation of the elastic drive power transmitting member 7 can be reset, that is, the elastic drive power transmitting member 7 can be returned to an initial state.

Furthermore, in the invention, though the components of the drive section 5 are basically incorporated into the sub-unit 4, they may be provided separately on the image forming apparatus body side and on the sub-unit 4 side so that the separated components can be coupled with each other when the sub-unit 4 is attached to the image forming apparatus body.

A concrete separation mode of a case where the components of the drive section 5 are provided separately, is described in an embodiment below.

DETAILED DESCRIPTION OF THE PREFERRED EMBODIMENTS

The invention will be described below in detail with reference to embodiments shown in accompanying drawings.

First Embodiment

Figure 3:
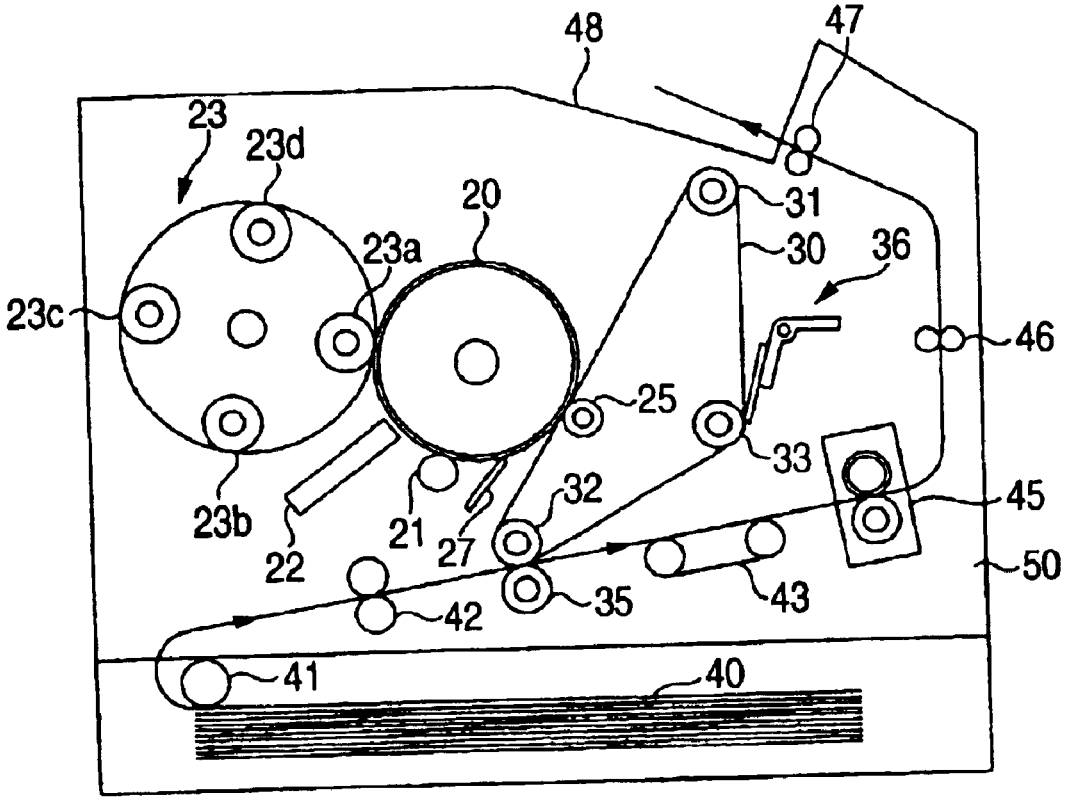
FIG. 3 is an explanatory view showing a first embodiment of the image forming apparatus to which the invention is applied.

FIG. 3 shows a first embodiment of an image forming apparatus to which the invention is applied.

FIG 3, the image forming apparatus includes, in an apparatus body 50, a photoconductor drum 20, and an intermediate transfer belt 30 arranged opposed to the photoconductor drum 20 in order to transfer a toner image from this photoconductor drum 20 thereon, and it is a four-cycle intermediate transfer type image forming apparatus in which multilayer transfer of four times is performed on the intermediate transfer belt 30 in order to obtain a color image of four colors.

In the embodiment, the photoconductor drum 20 has a photoconductive layer of which a resistance value lowers by irradiation of light. Around this photoconductive drum 20, there are arranged a charging device 21 that charges the photoconductor drum 20, an exposure device 22 that forms a electrostatic latent image of each color component (in this example, black (K), yellow (Y), magenta (M), and cyan (C)) on the charged photoconductor drum 20, a rotary type developing device 23 that makes visible the latent image of each color component formed on the photoconductor drum 20 with toner of each color component, the intermediate transfer belt 30, and a cleaning device 27 that cleans the residual toner on the photoconductor drum 20.

Here, as the charging device 21, for example, a charging roll is used. However, a charger such as a corotron may be used.

Further, as long as the exposure device 22 forms the image on the photoconductor drum 20 by the light, any device may be used. In this example, though a print head using LED is used, the exposure device is not limited to this. A print head using EL, or a scanner that scans a laser beam by a polygon mirror may be appropriately selected.

Further, the rotary type developing device 23 mounts thereon rotatably developing units 23*a* to 23*d* into which toner of each color component is stored. As long as the developing device attaches the toner of each color component to a portion on the photoconductor drum 20 where an electrical potential lowers by exposure, any developing device may be appropriately selected. Regarding used toner, there is no limitation in shape and particle diameter as long as the toner gets exactly on the electrostatic latent image on the photoconductor drum 20. Further, in the example, though the rotary developing device 23 is used, four developing devices may be used.

Furthermore, as the cleaning device 27, as long as it cleans the residual toner on the photoconductor drum 20, any cleaning device such as a cleaning device adopting a blade cleaning type may be appropriately selected. However, in case that toner having high transfer rate is used, there can be a mode in which the cleaning device 27 is not used.

Further, the intermediate transfer belt 30 is laid on three tension rolls 31 to 33, as shown in FIG. 3, and it moves circularly using the tension roll 31 as a drive roll.

Here, as the intermediate transfer belt 30, resin material such as polyimide or polycarbonate may be appropriately selected. However, in order to suppress an image defect such as a hollow character effectively, it is necessary to lower contact surface pressure between the intermediate transfer belt 30 and the photoconductor drum 20. Further, considering viewpoints of walkless and tensionerless, it is preferable that a rubber belt material in which elastic rubber is a base body (elastic layer) is used as the intermediate transfer belt 30.

Further, in the embodiment, at a portion of the intermediate transfer belt 30 opposed to the photoconductor drum 20, a first transfer roll 25 functioning as a first transfer member is arranged in contact with the intermediate transfer belt 30 on a rear side of the intermediate transfer belt 30, and a predetermined first transfer bias is applied onto the first transfer roll 25.

Furthermore, at a portion opposed to the tension roll 32 of the intermediate transfer belt 30, a second transfer roll 35 functioning as a second transfer member is arranged with the tension roll 32 used as a backup roll. For example, a predetermined second transfer bias is applied to the second transfer roll 35, and the tension roll 32 used as the backup roll is grounded.

Further, at a portion opposed to the tension roll 33 of the intermediate transfer belt 30, a belt cleaning device 36 is arranged in order to clean the residual toner on the intermediate transfer belt 30.

Further, a paper sheet 40 is stored into a sheet supply tray outside FIG. 3. After the paper sheet 40 is supplied by a feed roll 41, it is guided through regist rolls 42 to the second transfer section, and transported through a transporting belt 43 to a fixing device 45. Thereafter, it is stored through transporting rolls 46 and discharge rolls 47 on an exhausting tray 48 formed at the upper portion of the apparatus body 50.

Figure 4:
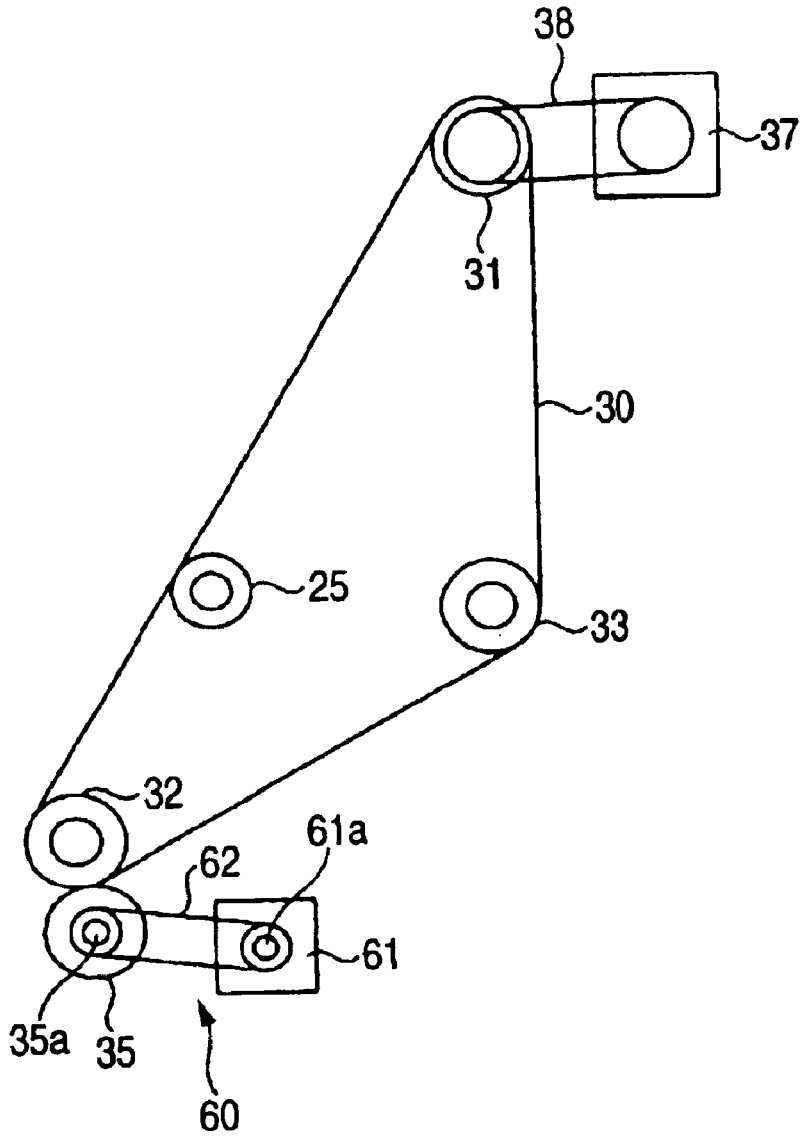
FIG. 4 is an explanatory view showing a drive device in the image forming apparatus according to the first embodiment.

In the embodiment, as shown in FIG. 4, the second transfer roll 35 has a drive device 60.

Namely, the second transfer roll 35 opposed to the tension roll 32 has a drive source 61. Further, an elastic drive power transmitting belt 62 composed of an elastic member is laid on a drive shaft 61*a* of the drive source 61 and a rotary support shaft 35*a* of the second transfer roll 35, and drive power from the drive source 61 is transmitted through the elastic drive power transmitting belt 62 to the second transfer roll 35.

On the other hand, the tension roll 31 of the intermediate transfer belt 30 has a drive source 37. Further, a drive power transmitting belt 38 is laid on the drive source 37 and the tension roll 31, and drive power from the drive source 37 is transmitted through the drive power transmitting belt 38 to the tension roll 31. Using this tension roll 31 as a drive roll, the intermediate transfer belt 30 is moved circularly.

Further, considering stability of the circular movement of the intermediate transfer belt 30, it is preferable that the drive power transmitting belt 38 is composed of a member having rigidity.

Here, the elastic drive power transmitting belt 62 is composed of an elastic member, transmits the drive power from the drive source 61, and absorbs difference in peripheral speed between the intermediate transfer belt 30 and the second transfer roll 35, wherein a relation of $\epsilon_d > \epsilon_i$ is satisfied, where $\epsilon_d$ is strain of the elastic drive power transmitting belt 62 in relation to an arbitrary load, and $\epsilon_i$ is strain of the intermediate transfer belt 30 in relation to its load.

In case that the strain of the elastic drive power transmitting belt 62 in relation to the arbitrary load is thus larger than the strain of the intermediate transfer belt 30 in relation to its load, when the second transfer roll 35 being in pressure contact with the intermediate transfer belt 30 about to change the moving speed of the intermediate transfer belt 30, before the intermediate transfer belt 30 expands and contracts, the elastic drive power transmitting belt 62 itself expands and contracts, so that the elastic drive power transmitting belt 62 can absorb the difference in peripheral speed produced between the intermediate transfer belt 30 and the second transfer roll 35.

Next, operation of the image forming apparatus according to the embodiment will be described with reference to the drive device 60 for the second transfer roll 35.

As shown in FIG. 4, in order to secondarily transfer on a sheet a multilayered toner image primarily transferred on the same portion on the intermediate transfer belt 30 circularly moved by the drive power transmitted through the drive power transmitting belt 38 from the drive source 37, when the second transfer roll 35 is brought into pressure contact with the intermediate transfer belt 30, a variation load is applied onto the intermediate transfer belt 30, so that the difference in peripheral speed is produced between the intermediate transfer belt 30 and the second transfer roll 35.

At this time, though the rotary drive power from the drive source 61 is transferred through the elastic drive power transmitting belt 62 to the second transfer roll 35 by the drive device 60, since this elastic drive power transmitting belt 62 is composed of the elastic member that is larger in strain in relation to the arbitrary load than the intermediate transfer belt 30, before the intermediate transfer belt 30 expands and contracts, the elastic drive power transmitting belt 62 itself expands and contracts, so that the elastic drive power transmitting belt 62 absorbs the difference in peripheral speed produced between the intermediate transfer belt 30 and the second transfer roll 35.

According to the embodiment, since the rotary drive power from the drive source 61 is transmitted through the elastic drive power transmitting belt 62 to the second transfer roll 35, the elastic drive power transmitting belt 62 transmits the rotary drive power elastically, whereby the elastic drive power transmitting belt 62 absorbs the difference in peripheral speed produced between the intermediate transfer belt 30 and the second transfer roll 35. Therefore, with a simple constitution, the speed variation, and the expansion and contraction of the intermediate transfer belt 30 can be prevented, so that it is possible to provide the image forming apparatus having stable running performance of the intermediate transfer belt 30.

Further, even if the strain of the elastic drive power transmitting belt 62 in relation to the arbitrary load is smaller than the strain of the intermediate transfer belt 30 in relation to its load, in case that the elastic drive power transmitting belt 62 and the intermediate transfer belt 30 are composed of the same elastic members (members that are equal in Young's modulus), the sectional area of the elastic drive power transmitting belt 62 is much smaller than that of the intermediate transfer belt 30. Therefore, the elastic drive power transmitting belt 62 becomes larger in strain in relation to the same load.

Second Embodiment

Figure 5:
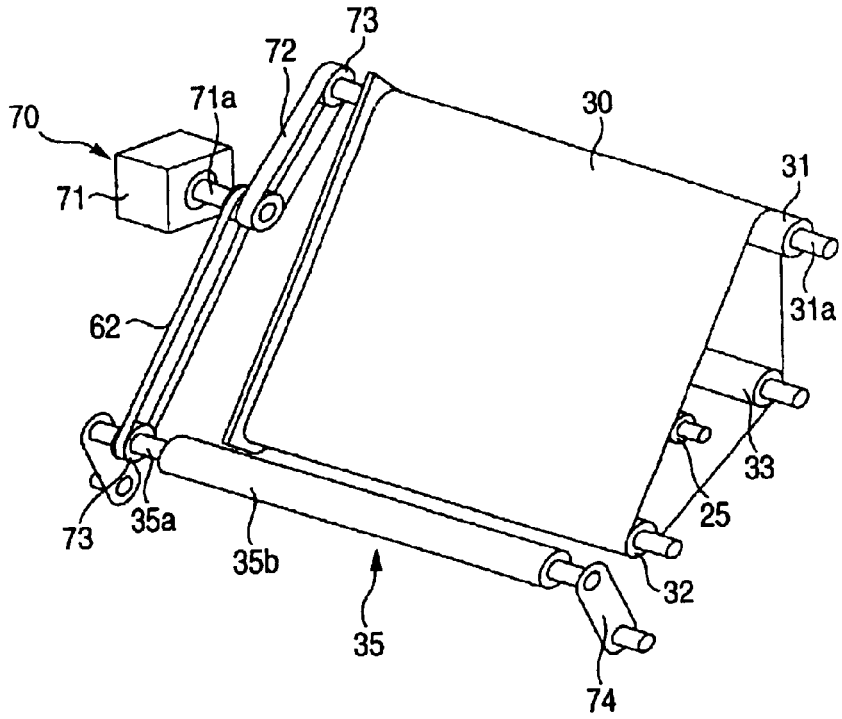
FIG. 5 is an explanatory view showing a drive device according to a second embodiment of the image forming apparatus to which the invention is applied.

FIG. 5 shows a second embodiment of the image forming apparatus to which the invention is applied, in which a drive 70 device is shown.

In FIG. 5, a drive device 70 according to this embodiment has an elastic drive power transmitting belt 62 similar to the drive device 60 in the first embodiment. However, the drive device 70 in this embodiment is different from the first embodiment in that an intermediate transfer belt 30 and a second transfer roll 35 are driven by drive power from the same drive source 71.

The drive device 70 according to this embodiment is, as shown in FIG. 5, provided with the drive source 71, and a timing belt 72 laid between an end portion of a drive shaft 71*a* of this drive source 71 and a pulley 73 provided for an end portion (on the left in this embodiment) of a rotary support shaft 31*a* of a tension roll 31 (drive roll 31), while an elastic drive power transmitting belt 62 is laid between an end portion of the drive shaft 71*a* closer to the drive source 71 side than the timing belt 72 and a pulley 73 provided for an end portion (on the left in this embodiment) of a rotary support shaft 35*a* of a second transfer roll 35.

Reference numeral 74 is a retractor arm for making the second transfer roll 35 connectable and disconnectable with the intermediate transfer belt 30 by swinging.

Further, the second transfer roll 35 is covered with a member 35*b* made of foam rubber thereby to eliminate a difference in outer diameter between the second transfer roll surface and the pulley 73.

When the second transfer roll 35 comes into pressure contact with the intermediate transfer belt 30, the drive power from the drive source 71 is transmitted through the timing belt 72 to the drive roll 31 of the intermediate transfer belt 30, and it is transmitted through the elastic drive power transmitting belt 62 and the pulley 73 to the second transfer roll 35.

The same components as those in the first embodiment are denoted with the same reference numerals, and their detailed description is omitted.

According to the embodiment, difference in peripheral speed produced between the intermediate transfer belt 30 and the second transfer roll 35 is absorbed by the elastic drive power transmitting belt 62. Further, since the intermediate transfer belt 30 and the second transfer roll 35 are driven by the same drive source 71, compared with a case where the drive sources are individually provided for the both, the speed variation component due to the drive source can be cancelled, so that more stable running performance of the intermediate transfer belt 30 can be secured.

Third Embodiment

Figure 6:
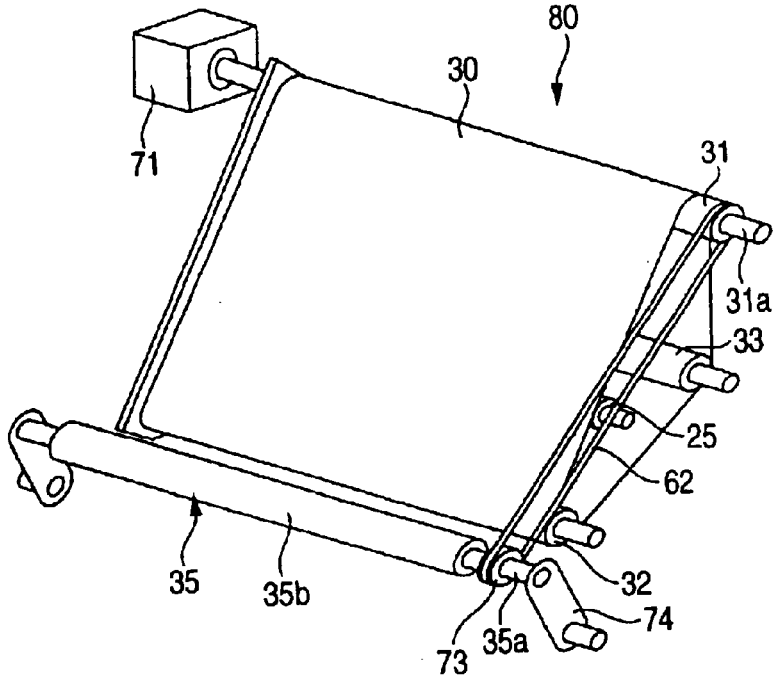
FIG. 6 is an explanatory view showing the drive device according to a third embodiment of the image forming apparatus to which the invention is applied.

FIG. 6 shows a third embodiment of the image forming apparatus to which the invention is applied, in which a drive device 80 is shown.

In FIG. 6, a drive device 80 according to this embodiment has an elastic drive power transmitting belt 62 similar to the drive device 70 in the second embodiment. However, the drive device 80 in this embodiment is different from the second embodiment in that a second transfer roll 35 is rotationally driven by a drive roll 31 of an intermediate transfer belt 30.

In this embodiment, in the drive device 80, as shown in FIG. 6, an elastic drive power transmitting belt 62 is laid between a pulley 73 provided for an end portion (on the right in this embodiment) of a rotary support shaft 35*a* of the second transfer roll 35 and a tension roll 31 (drive roll 31) of the intermediate transfer belt 30, and a drive source 71 is provided for an end (on the left in this example) of a rotary support shaft 31*a* of the drive roll 31.

Further, outer diameter of the pulley 73 is approximately the same as that of the second transfer roll 35.

When the second transfer roll 35 comes into contact with the intermediate transfer belt 30, the drive roll 31 rotates by the drive power from the drive source 71, and this rotary drive power is transmitted through the elastic drive power transmitting belt 62 and the pulley 73 to the second transfer roll 35.

The same components as those in the second embodiment are denoted with the same reference numerals, and their detailed description is omitted.

According to this embodiment, since the second transfer roll 35 obtains the drive power from the drive roll 31 directly driving the intermediate transfer belt 30, the peripheral speed of the second transfer roll 35 can be accurately matched with that of the intermediate transfer belt 30.

Therefore, difference in peripheral speed produced between the intermediate transfer belt 30 and the second transfer roll 35 is due to only difference in outer diameter between the pulley 73 provided for the end portion of the rotary support shaft 35*a* of the second transfer roll 35 and the drive roll surface. Since their outer diameters are approximately the same, they can rotate at the same speed, so that stable running performance of the intermediate transfer belt 30 can be secured.

Though there is actually the difference in peripheral speed due to influences of run out of the second transfer roll 35 and of run out of the tension roll 32 opposed to the second transfer roll 35, the run out of the second transfer roll 35 and of the tension roll 32 are periodical variation components, and the amount of speed variation is permitted in a predetermined range. Therefore, by suppressing the peripheral speed difference that the elastic drive power transmitting belt 62 can absorb in this range, the variation load onto the intermediate transfer belt 30 can be reduced.

However, when the intermediate transfer belt 30 and the second transfer roll 35 come into contact with each other and their turn is repeated, the difference in outer diameter between the pulley 73 and the second transfer roll 35 becomes stored peripheral speed difference, and there is fear that this stored peripheral speed difference exceeds the peripheral speed difference absorbable range of the elastic drive power transporting belt 62.

At this time, since the pulley 73 comes into contact with the elastic drive power transmitting belt 62 and slips, the speed variation produced by the peripheral speed difference stored in the elastic drive power transmitting belt 62 is suppressed, so that a factor of the speed variation given to the intermediate transfer belt 30 can be reduced.

Namely, the periodical variation factor in the peripheral speed difference produced between the intermediate transfer belt 30 and the second transfer roll 35 is absorbed by elasticity of the elastic drive power transmitting belt 62, and the variation factor in the peripheral speed difference stored in the elastic drive power transmitting belt 62 can be absorbed by slip of the pulley 73.

Here, when a radius of the second transfer roll 35 is equal to that of the pulley 73, frictional power F acting between the elastic drive power transmitting belt 62 and the pulley 73 must be in the following range:

$$T_r/R<F<E_1\cdot\epsilon_{max}\cdot A$$

Herein, $T_r$ is required drive torque of the second transfer roll 35, R is a radius of the second transfer roll 35 and the pulley 73, $E_1$ is Young's modulus of the intermediate transfer belt 30, $\epsilon_{max}$ is strain permitted in the intermediate transfer belt 30, and A is a sectional area of the intermediate transfer belt 30.

Namely, the frictional power acting between the elastic drive power transmitting belt 62 and the intermediate transfer belt 30 is larger than the power necessary to rotate the second transfer roll 35, and it must be in a range where the power that expands the intermediate transfer belt 30 does not affect image quality.

Further, the strain $\epsilon_{max}$ permitted in the intermediate transfer belt 30 is strain amount that gives an influence to disturbance in image, and it is generally desirable that the permissible strain amount upon color image formation is below 50–100 μm.

Fourth Embodiment

Figure 7:
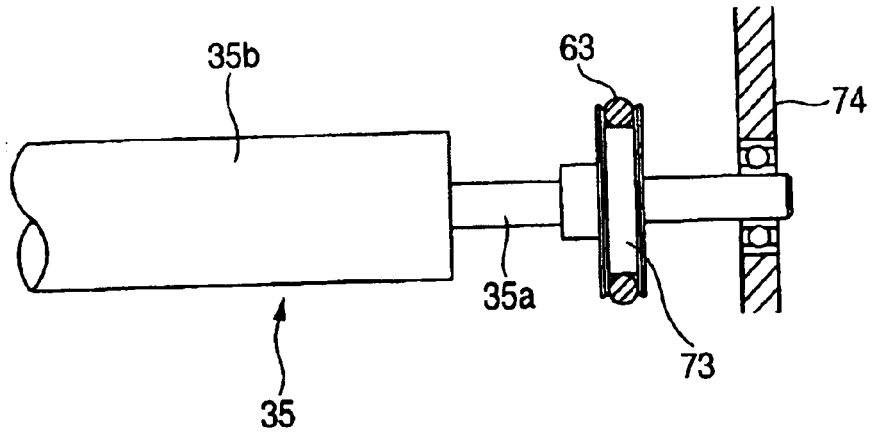
FIG. 7 is an explanatory view showing an elastic drive power transmitting belt according to a fourth embodiment of the image forming apparatus to which the invention is applied.

FIG. 7 shows a fourth embodiment of the image forming apparatus to which the invention is applied, in which an elastic drive power transmitting belt 63 is shown.

In FIG. 7, the basic constitution of the image forming apparatus according to this embodiment is similar to that of the image forming apparatus according to the third embodiment. However, this embodiment is different from the third embodiment in that an elastic drive power transmitting belt 63 is an endless belt having an approximately circular section, and a radius of curvature of a section of its fitting portion to a pulley 73 is smaller than a radius of curvature of the pulley section.

According to this mode, a contact area between the elastic drive power transmitting belt 63 and the pulley 73 becomes small, so that slip can be generated easily.

Figure 8:
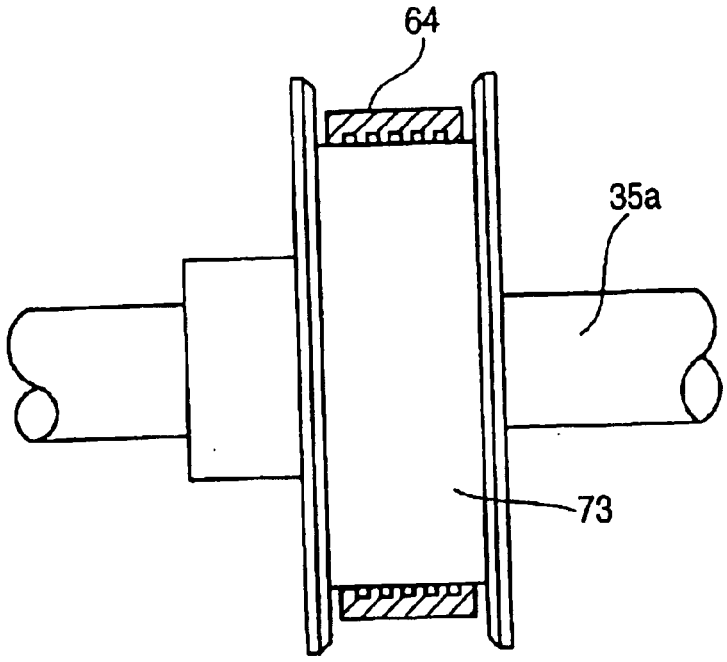
FIG. 8 is an explanatory view showing an elastic drive power transmitting belt according to the fourth embodiment of the image forming apparatus to which the invention is applied.

Further, another mode of the elastic drive power transmitting belt 64 will be shown in FIG. 8.

In FIG. 8, an elastic drive power transmitting belt 64 is composed of a flat belt in which grooves are formed on its surface in the longitudinal direction. The elastic drive power transmitting belt 64 has limitation in size of belt width and tension according to the degree of the transporting drive power and the absorbing peripheral speed difference. Therefore, it is necessary to adjust the slip amount between the elastic drive power transmitting belt 64 and a pulley 73. According to this mode, the unevenness on the surface of the elastic drive power transmitting belt 64 can adjust the contact area with the pulley 73, so that the slip amount between the elastic drive power transmitting belt 64 and the pulley 73 can be adjusted.

Further, the same components as those in the third embodiment are denoted with the same reference numerals, and their detailed description is omitted.

Fifth Embodiment

Figure 9:
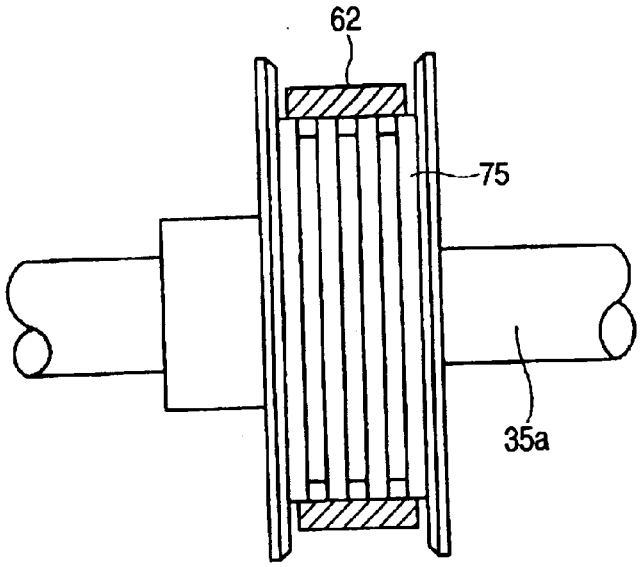
FIG. 9 is an explanatory view showing a pulley according to a fifth embodiment of the image forming apparatus to which the invention is applied.

FIG. 9 shows a fifth embodiment of the image forming apparatus to which the invention is applied, in which a pulley 75 is shown.

In FIG. 9, the basic constitution of the image forming apparatus according to this embodiment is similar to that of the image forming apparatus according to the third embodiment. However, this embodiment is different from the third embodiment in that a pulley 75 has grooves on its surface in the longitudinal direction.

According to this mode, in a fitting surface between the pulley 75 and an elastic drive power transmitting belt 62, the contact area with the elastic drive power transmitting belt 62 can be adjusted by the evenness of the pulley surface. Therefore, the slip amount between the elastic drive power transmitting belt 62 and the pulley 75 can be adjusted similarly to in the fourth embodiment.

Further, the same components as those in the third embodiment are denoted with the same reference numerals, and their detailed description is omitted.

Sixth Embodiment

Figure 10:
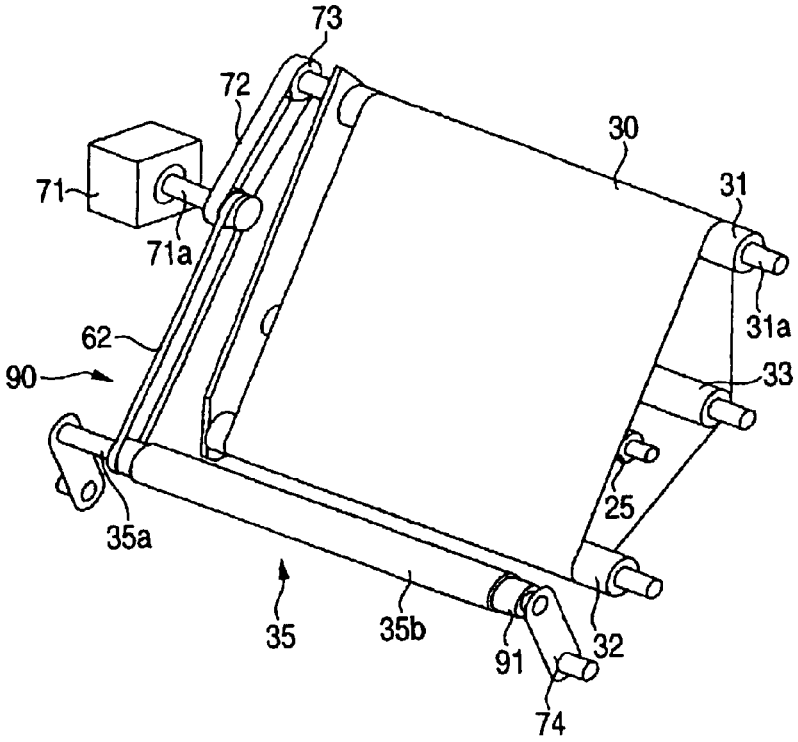
FIG. 10 is an explanatory view showing a drive device according to a sixth embodiment of the image forming apparatus to which the invention is applied.

FIG. 10 shows a sixth embodiment of the image forming apparatus to which the invention is applied, in which a drive device 90 is shown.

In FIG. 10, a drive device 90 according to this embodiment has an elastic drive power transmitting belt 62 similarly to the drive device 70 in the second embodiment. However, the drive device 90 in this embodiment is different from that in the second embodiment in that the elastic drive power transmitting belt 62 is laid on a tracking roll 91, and drive power from a drive source 71 is transmitted through the tracking roll 91 to a second transfer roll 35.

In this embodiment, the drive device 90, as shown in FIG. 10, includes at a part of the second transfer roll 35 a tracking section (tracking roll 91) that performs positioning to an intermediate transfer belt 30 in order to regulate the squeeze amount by press of the second transfer roll 35 against the intermediate transfer belt 30. The elastic drive power transmitting belt 62 is laid on this tracking roll 91 to transmit the drive power from the drive source to the second transfer roll 35.

Figure 11:
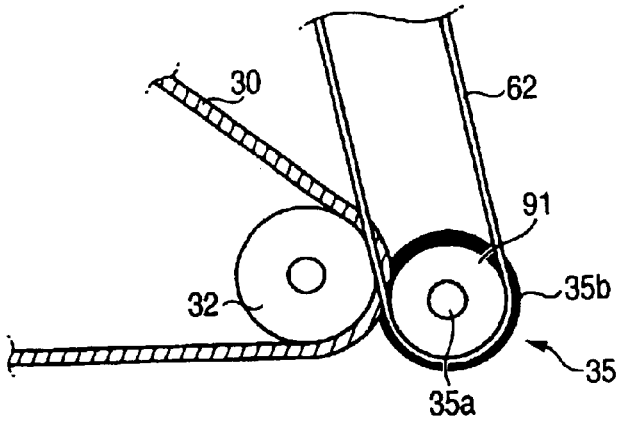
FIG. 11 is an explanatory view showing a pressure-contact state between an intermediate transfer belt and a second transfer roll in the drive device according to the sixth embodiment.

Here, the tracking roll 91, as shown in FIG. 11, is coaxial with a rotary support shaft 35*a* of the second transfer roll 35, slightly smaller in diameter than the second transfer roll 35, and formed integrally with the second transfer roll 35. Around the tracking roll 91, the elastic drive power transmitting belt 62 is laid.

Further, when the intermediate transfer belt 30 laid on a tension roll 32 is brought into pressure contact with the second transfer roll 35, it presses and squeezes a surface member 35*b* of the second transfer roll 35 composed of foam rubber. This squeezing of the intermediate transfer belt 30 is prevented by the tracking roll 91.

Further, the same components as those in the second embodiment are denoted with the same reference numerals, and their detailed description is omitted.

According to this embodiment, in the drive device 90, the elastic drive power transmitting belt 62 is laid on the tracking roll 91 molded integrally with the second transfer roll 35 thereby to transmit the drive power from the drive source 71 to the second transfer roll 35. Therefore, compared with the mode in which the drive power from the drive source 71 is indirectly transmitted to the second transfer roll 35 using the pulley 73, since the drive power from the drive source 71 is directly transmitted to the second transfer roll 35, the rotary accuracy improves.

Seventh Embodiment

Figure 12:
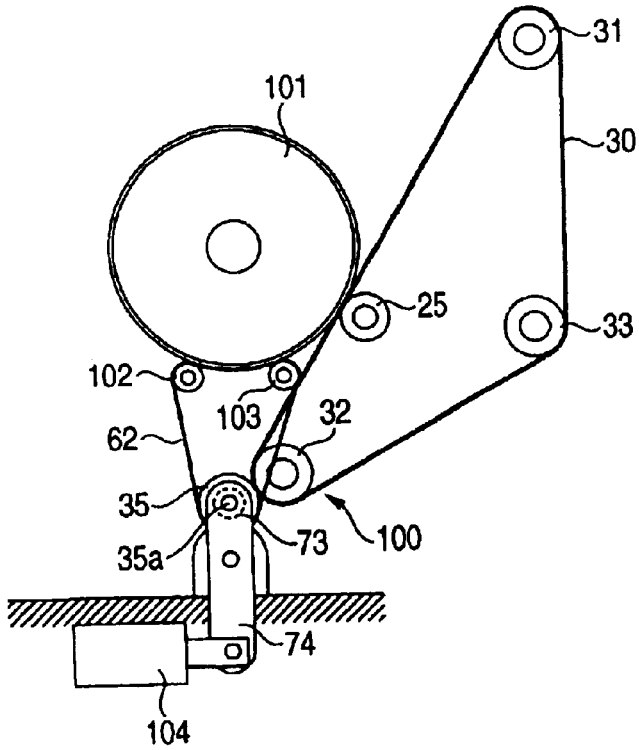
FIG. 12 is an explanatory view showing a drive device of an image forming apparatus according to a seventh embodiment.

FIG. 12 shows a seventh embodiment of the image forming apparatus to which the invention is applied, in which a drive device 100 is shown.

In FIG. 12, the basic constitution of the image forming apparatus according to this embodiment is approximately similar to that of the image forming apparatus according to the first embodiment. However, this embodiment is different from the first embodiment in that a photoconductor drum 101 that comes into pressure contact with an intermediate transfer belt 30 is provided, the intermediate transfer belt 30 is circularly moved by surface friction produced between the circumscribed photoconductor drum 101 and it.

Further, a drive device 100 according to this embodiment, as shown in FIG. 12, includes pulleys 102 and 103 which are provided on the surface of the photoconductor drum 101 and rotate integrally with the photoconductor drum 101, and an elastic drive power transmitting belt 62 is laid between these pulleys 102, 103 and a pulley 73 provided for an end portion of a rotary support shaft 35*a* of a second transfer roll 35.

When the photoconductor drum 101 rotates by drive power from a drive source outside the figure, not only the intermediate transfer belt 30 is driven and moves circularly but also the rotary drive power from the photoconductor drum 101 is transmitted through the elastic drive power transmitting belt 62 laid on the pulleys 102, 103 and 73 to the second transfer roll 35, so that the second transfer roll 35 is driven and rotates.

Reference numeral 104 is a drive source for bringing the second transfer roll 35 into pressure contact with or separating it from the intermediate transfer belt 30.

Further, the same components as those in the first embodiment are denoted with the same reference numerals, and their detailed description is omitted.

Also in this embodiment, the rotary drive power is transmitted through the elastic drive power transmitting belt 62 to the second transfer roll 35. Therefore, peripheral speed difference produced between the intermediate transfer belt 30 and the second transfer roll 35 is absorbed by the elastic drive power transmitting belt 62, so that stable running performance of the intermediate transfer belt 30 can be secured.

Further, since the intermediate transfer belt 30 and the second transfer roll 35 are driven and rotate by the rotary drive power of the photoconductor drum 101, the speed variation component due to the drive source, which is caused in case that the drive sources are provided respectively, can be cancelled.

In this example, though the pulleys 102 and 103 are provided for the photoconductor drum 101, they may be provided coaxially with a drive shaft of the photoconductor drum 101 and rotated integrally with the photoconductor drum 101.

Eighth Embodiment

Figure 13:
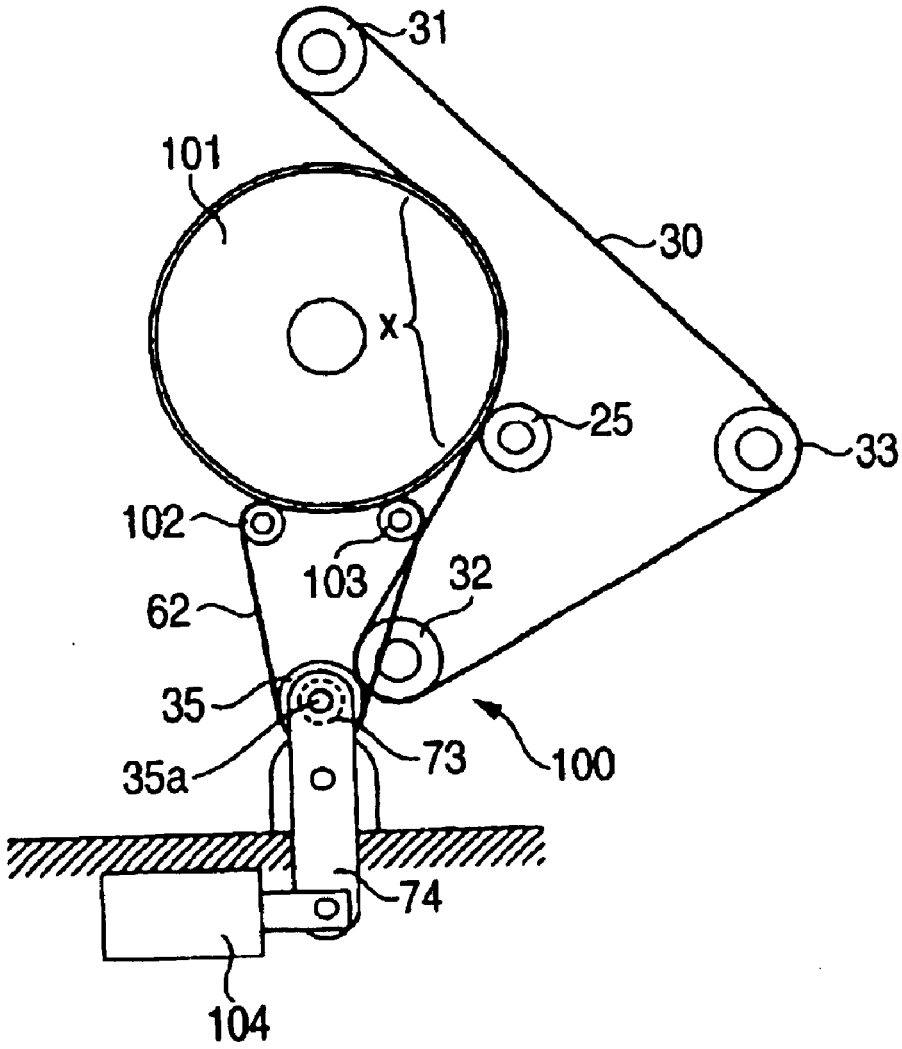
FIG. 13 is an explanatory view showing a drive device of an image forming apparatus according to an eighth embodiment.

FIG. 13 shows an eighth embodiment of an image forming apparatus to which the invention is applied.

In FIG. 13, the basic constitution of the image forming apparatus according to this embodiment is approximately similar to that of the image forming apparatus according to the seventh embodiment. However, this embodiment is different from the seventh embodiment in that an intermediate transfer belt 30 is composed of elastic rubber belt material, and it is arranged in contact with a photoconductor drum 101 along the shape of the photoconductor drum 101 at a predetermined contact region x. Further, the same components as those in the seventh embodiment are denoted with the same reference numerals, and their detailed description is omitted.

In this embodiment, toner images of respective color components are formed successively on the photoconductor drum 101, transferred through the contact region x (first transfer position) onto the intermediate transfer belt 30 successively, and thereafter transferred in the lump at a second transfer position on a sheet by a second transfer roll 35.

In such an image forming process, the photoconductor drum 101 and the intermediate transfer belt 30 are arranged in contact with each other at the comparatively wide contact region x, and the photoconductor drum 101 is elastically pressed by the elastic rubber belt material. Therefore, tack surface pressure between the photoconductor drum 101 and the intermediate transfer belt 30 is not too high, a wrap-in operation of toner image by the elastic rubber belt material is performed, and the toner images on the photoconductor drum 101 are transferred in the lump onto the intermediate transfer belt side.

At this time, there is no image defect such as a hollow character produced due to large tack surface pressure in the transfer image onto the intermediate transfer belt 30, and transfer is performed with high transfer efficiency. Therefore, a color image on the sheet is kept very good.

Further, also in this embodiment, the rotary drive power of the photoconductor drum 101 is transferred through an elastic drive power transmitting belt 62 to the second transfer roll 35. Therefore, peripheral speed difference produced between the intermediate transfer belt 30 and the second transfer roll 35 is absorbed by the elastic drive power transmitting belt 62, so that stable running performance of the intermediate transfer belt 30 can be secured.

Ninth Embodiment

Figure 14A:
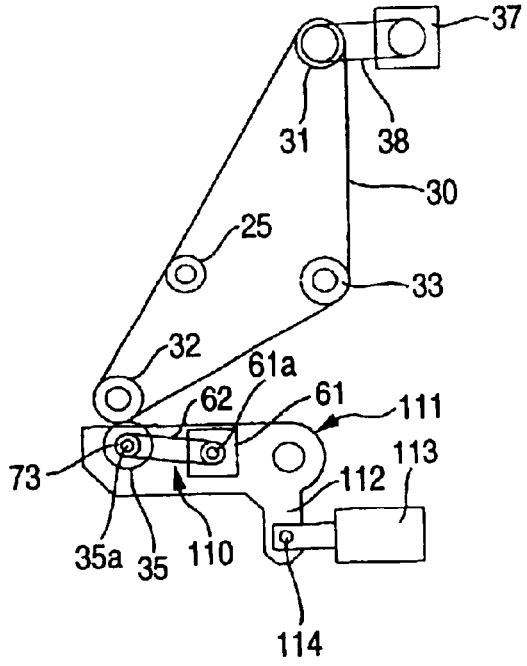
FIGS. 14A is an explanatory view showing pressure contact of a second transfer roll with an intermediate transfer belt of a drive device in an image forming apparatus according to a ninth embodiment.
Figure 14B:
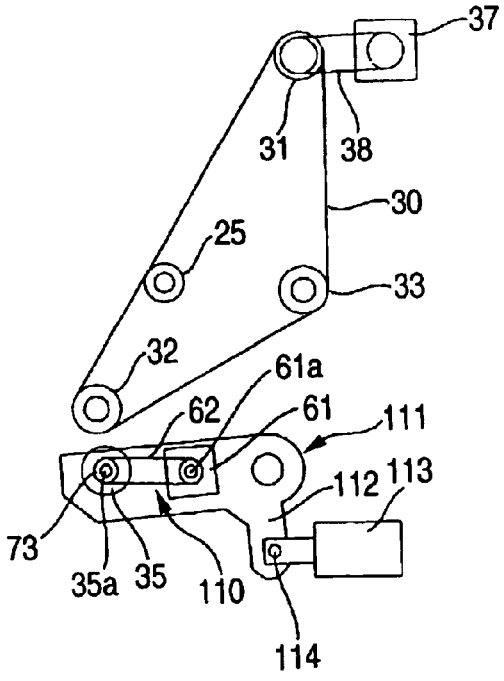
FIG. 14B is an explanatory view showing separation of the second transfer roll from the intermediate transfer belt of the drive device.

FIGS. 14A and 14B show a ninth embodiment of the image forming apparatus to which the invention is applied, in which a drive device 110 is shown.

In FIG. 14, a drive device 110 according to this embodiment has an elastic drive power transmitting belt 62 similarly to the drive device 60 in the first embodiment. However, the drive device 110 in this embodiment is different from that in the first embodiment in that: a pulley 73 functioning as a slip transmission member is attached to a rotary support shaft 35*a* of a second transfer roll 35, the drive device 110 is incorporated into a transfer unit 111 having the second transfer roll 35 in its unit body, and this transfer unit 111 is attached detachably to the image forming apparatus body.

Further, the same components as those in the first embodiment are denoted with the same reference numerals, and their detailed description is omitted.

In this embodiment, the drive device 110, as shown in FIGS. 14A and 14B, includes a drive source 61, an elastic drive power transmitting belt 62 is laid between the pulley 73 provided at the end portion of the rotary support shaft 35*a* of the second transfer roll 35 and a drive shaft 61*a* of the drive source 61, and the drive power from the drive source 61 is transmitted through the elastic drive power transmitting belt 62 and the pulley 73 to the second transfer roll 35.

Further, one end of an oscillation arm 112 of the transfer unit 111 is coupled to a drive source 113 by a pin 114, and the oscillation arm 112 rotates about this pin 114.

Further, the second transfer roll 35 is provided separably from an intermediate transfer belt 30. At the second transfer time, the second transfer roll 35 comes into pressure contact with the intermediate transfer belt 30; and at the second transfer completion time, it separates from the intermediate transfer belt 30.

Next, operation of the image forming apparatus according to this embodiment will be described with reference to the drive device 110.

At the second transfer time, as shown in FIG. 14A, the oscillation arm 112 of the transfer unit 111 rotates clockwise about the pin 114 by the drive power from the drive source 113, and the second transfer roll 35 comes into pressure contact with the intermediate transfer belt 30. Then, a variation load is applied onto the intermediate transfer belt 30, so that peripheral speed difference is produced between the intermediate transfer belt 30 and the second transfer roll 35.

At this time, the rotary drive power from the drive source 61 is transmitted by the drive device 110 to the second transfer roll 35 through the elastic drive power transmitting belt 62 and the pulley 73. However, since this elastic drive power transmitting belt 62, compared with the intermediate transfer belt 30, is composed of an elastic member that is larger in strain in relation to an arbitrary load, it absorbs the peripheral speed difference produced between the intermediate transfer belt 30 and the second transfer roll 35.

Further, also in case that the peripheral speed difference produced between the intermediate transfer belt 30 and the second transfer roll 35 is stored, expansion and contraction of the elastic drive power transmitting belt 62 reaches a maximum, and the elastic drive power transmitting belt 62 cannot absorb the stored peripheral speed difference, the pulley 73 comes into contact with the elastic drive power transmitting belt 62 and generates slip, whereby a factor of the speed variation given to the intermediate transfer belt 30 can be reduced.

On the other hand, when the second transfer is completed, as shown in FIG. 14B, the oscillation arm 112 of the transfer unit 111 rotates counterclockwise about the pin 114 by the drive power from the drive source 113, and the second transfer roll 35 separates from the intermediate transfer belt 30.

Further, in a state where the second transfer roll 35 in the transfer unit 111 separates from the intermediate transfer belt 30, the transfer unit 111 is detachable from the image forming apparatus body. When the second transfer roll 35 is exchanged because of its life, the transfer unit 111 can be detached as one body from the image forming apparatus, so that the second transfer roll 35 can be readily exchanged.

Further, since the second transfer roll 35 is provided separably from the intermediate transfer belt 30, when the second transfer roll 35 separates from the intermediate transfer belt 30, elastic deformation of the elastic drive power transmitting belt 62 can be reset, that is, the elastic drive power transmitting belt 62 can be returned to an initial state.

Further, the pulley 73, in the embodiment, is attached to the rotary support shaft 35*a* of the second transfer roll 35. However, as long as the pulley 73 engages with the elastic drive power transmitting belt 62 and generates slip, it may be attached to the drive shaft 61*a* of the drive source 61, or it may be also attached to both of the rotary support shaft 35*a* and the drive shaft 61*a*.

Tenth Embodiment

Figure 15A:
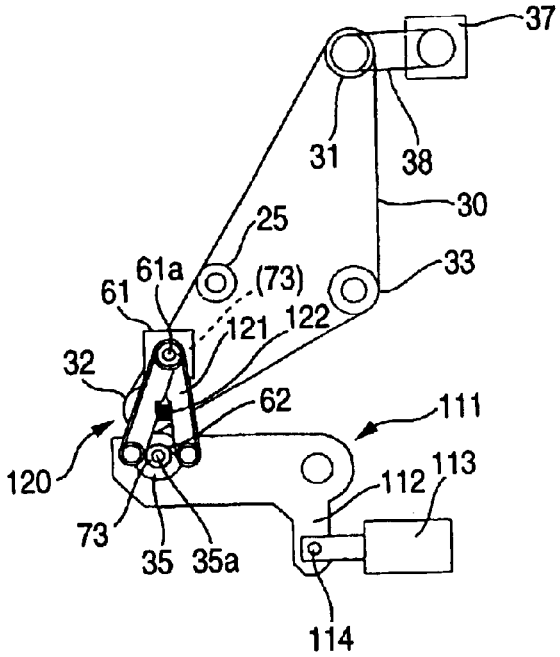
FIGS. 15A is an explanatory view showing pressure contact of a second transfer roll with an intermediate transfer belt of a drive device in an image forming apparatus according to a tenth embodiment.
Figure 15B:
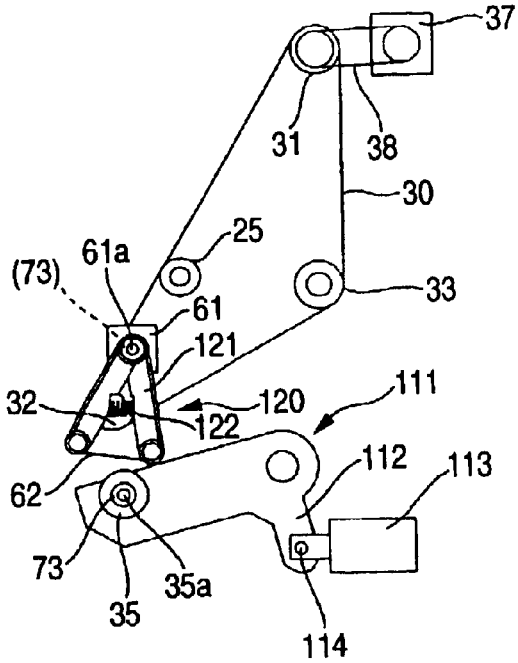
FIG. 15B is an explanatory view showing separation of the second transfer roll from the intermediate transfer belt of the drive device.

FIGS. 15A and 15B shows a tenth embodiment of the image forming apparatus to which the invention is applied, in which a drive device 120 is shown.

In FIG. 15, the basic constitution of a drive device 120 according to this embodiment is approximately similar to that of the drive device 110 according to the ninth embodiment. However, this embodiment is different from the ninth embodiment in that components of the drive device 120 are provided separately on an image forming apparatus body side and a transfer unit side, and they can be coupled to each other when the transfer unit 111 is attached to the image forming apparatus body.

Further, the same components as those in the ninth embodiment are denoted with the same reference numerals, and their detailed description is omitted.

In this embodiment, a drive source 61, an elastic drive power transmitting belt 62 and a pulley 73 functioning as a slip transmission member are, as shown in FIGS. 15A and 15B, provided separately on the image forming apparatus body side and the transfer unit side.

Namely, on the image forming apparatus body side, the drive source 61 is provided, a V-shaped arm 121 that opens and closes with a drive shaft 61*a* as a support axis is provided for the drive shaft 61*a* of this drive source 61, and the elastic drive power transmitting belt 62 is laid along an external shape of the V-shaped arm 121 approximately in the shape of a triangle with the drive shaft 61*a* as a vertex.

Further, this V-shaped arm 121, so that it always returns to a state where it opens at a constant angle, is urged at each of its arm intermediate portions by an urging spring 122.

On the other hand, to a rotary support shaft 35*a* of a second transfer roll 35 in the transfer unit 111, the pulley 73 is attached.

When the second transfer roll 35 comes into pressure contact with an intermediate transfer belt 30, the elastic drive power transmitting belt 62 and the pulley 73 are fitted to each other, so that rotary drive power from the drive source 61 is transmitted through the elastic drive power transmitting belt 62 and the pulley 73 to the second transfer roll 35.

Next, operation of the image forming apparatus according to the embodiment will be described with reference to the drive device 120.

At the second transfer time, as shown in FIG. 15A, by the drive power from the a drive source 113, an oscillation arm 112 of the transfer unit 111 rotates clockwise about a pin 114, and the second transfer roll 35 comes into pressure contact with the intermediate transfer belt 30.

At this time, the elastic drive power transmitting belt 62 is pushed upward by the pulley 73 attached to the rotary support shaft 35*a* of the second transfer roll 35, both arms of the V-shaped arm 121 are gradually closing against the urging power of the urging spring 122, and the pulley 73 fits at its arc portion to the elastic drive power transmitting belt 62.

And, the rotary drive power from the drive source 61 is transmitted through the elastic drive power transmitting belt 62 and the pulley 73 to the second transfer roll 35 to perform second transfer.

On the other hand, when the second transfer ends, as shown in FIG. 15B, by the drive power from the drive source 113, the oscillation arm 112 of the transfer unit 111 rotates counterclockwise about the pin 114, and the second transfer roll 35 separates from the intermediate transfer belt 30.

At this time, when the second transfer roll 35 separates from the intermediate transfer belt 30, the pulley 73 separates from the elastic drive power transmitting belt 62, both arms of the V-shaped arm 121 open according to the urging power of the urging spring 122, and the elastic drive power transmitting belt 62 comes to a tensioned state along the surroundings of the V-shaped arm 121.

Thus, in case that the components of the drive device 120 are arranged so that they can fitted to each other when the transfer unit 111 is attached to the image forming apparatus body, they can be provided separately on the image forming apparatus body side and the transfer unit side.

Further, though the pulley 73 in the embodiment is attached to the rotary support shaft 35*a* of the second transfer roll 35, as long as it engages with the elastic drive power transmitting belt 62 and generates slip, it may be attached to the drive shaft 61*a* of the drive source 61, or it may be attached to both of the rotary support shaft: 35*a* and the drive shaft 61*a*.

Eleventh Embodiment

Figure 16A:
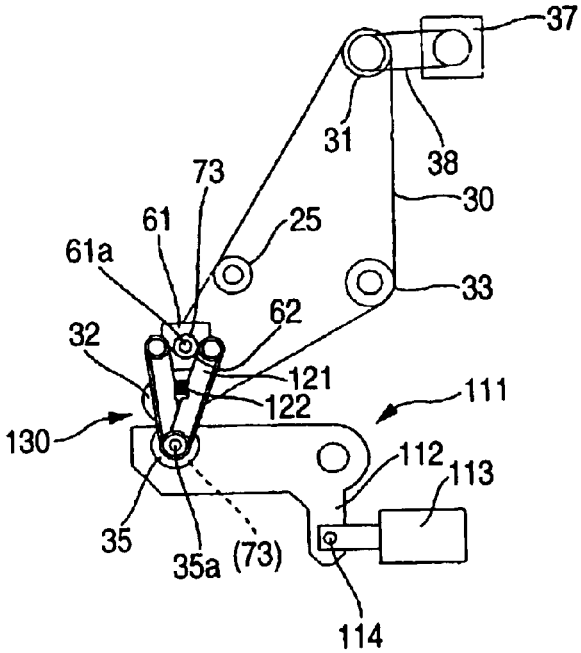
FIG. 16A is an explanatory view showing pressure contact of a second transfer roll with an intermediate transfer belt of a drive device in an image forming apparatus according to an eleventh embodiment.
Figure 16B:
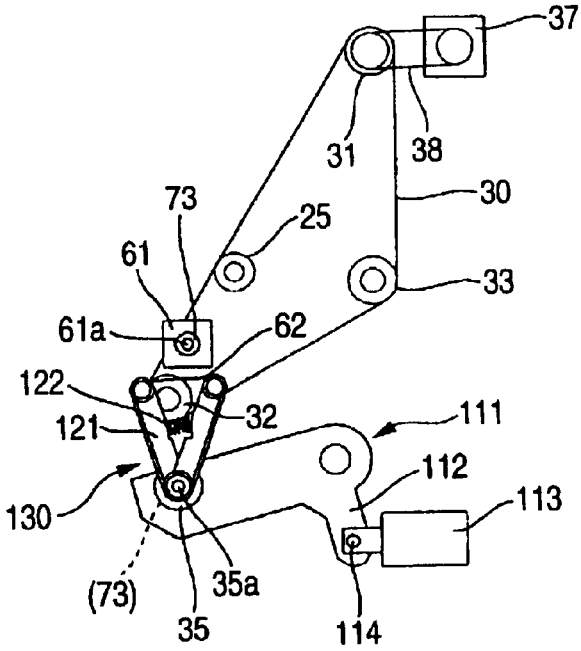
FIG. 16B is an explanatory view showing separation of the second transfer roll from the intermediate transfer belt of the drive device.

FIGS. 16A and 16B shows an eleventh embodiment of the image forming apparatus to which the invention is applied, in which a drive device 130 is shown.

In the FIG. 16, components of the drive device 130 according to this embodiment are provided separately on an image forming apparatus body side and a transfer unit side similarly to in the tenth embodiment, and they can be coupled to each other when the transfer unit 111 is attached to the image forming apparatus body. However, this embodiment is different from the tenth embodiment in separation form of the components of the drive device 130.

Further, the same components as those in the tenth embodiment are denoted with the same reference numerals, and their detailed description is omitted.

In this embodiment, a drive source 61, an elastic drive power transmitting belt 62 and a pulley 73 functioning as a slip transmission member that are components of the drive device 130 are, as shown in FIGS. 16A and 16B, provided separately on the image forming apparatus body side and the transfer unit side.

Namely, on the image forming apparatus body side, the drive source 61 is provided, and the pulley 73 is attached to a drive shaft 61*a* of this drive source 61.

On the other hand, a V-shaped arm 121 that opens and closes from side to side with a rotary support shaft 35*a* as a support axis is provided for the rotary support shaft 35*a* of a second transfer roll 35 in the transfer unit 111, and the elastic drive power transmitting belt 62 is laid along an external shape of the V-shaped arm 121 approximately in the shape of a triangle with the rotary support shaft 35*a* as a vertex.

Further, this V-shaped arm 121, so that it always returns to a state where it opens at a constant angle, is energized at each of its arm intermediate portions by an energizing spring 122.

When the second transfer roll 35 comes into pressure contact with an intermediate transfer belt 30, the elastic drive power transmitting belt 62 engages with the pulley 73, the rotary drive power from the drive source 61 is transmitted through the elastic drive power transmitting belt 62 and the pulley 73 to the second transfer roll 35.

Further, though the pulley 73 in the embodiment is attached to the drive shaft 61*a* of the drive source 61, as long as it engages with the elastic drive power transmitting belt 62 and generates slip, it may be attached to the rotary support shaft 35*a* of the second transfer roll 35, or it may be attached to both of the drive shaft 61*a* and the rotary support shaft 35*a*.

As described above, according to the invention, in the image forming apparatus provided with the image transporting belt that holds an image directly or indirectly and is laid on a plurality of tension rolls thereby to move circularly, and a sub-unit having the rotary roll that comes into contact with this image transporting belt and is rotationally driven by the drive section, the drive section includes the drive source, and the elastic drive power transmitting member that transmits drive power from the drive source and absorbs difference in peripheral speed produced between the image transporting belt and the rotary roll. Therefore, it is possible to provide an image forming apparatus, in which the speed variation, and the expansion and contraction of the transfer belt can be prevented with a simple constitution without depending on accuracy of parts, stable running performance of the transfer belt can be secured, and color multilayer accuracy of color image can improve thereby to obtain a good image having little color registration error.

Further, in case that the drive section includes the drive source and the slip transmission member that engages with the elastic drive power transmitting member and slips under a condition over a peripheral speed difference absorbable range of the elastic drive power transmitting member, the periodical speed variation factor in the peripheral speed difference produced between the image transporting belt and the rotary roll is absorbed by elasticity of the elastic drive power transmitting member, and the speed variation produced by the peripheral speed difference stored in the elastic drive power transmitting member is suppressed by the slip generated by the slip transmission member. In result, the speed variation given to the image transporting belt can be prevented.

What is claimed is:

1. An image forming apparatus comprising:

an image transporting belt that holds an image directly or indirectly and is laid on a plurality of tension rolls to move circularly; and a sub-unit having a rotary roll that comes into contact with the image transporting belt and a drive section for rotationally driving the rotary roll, wherein the drive section includes a drive source, and an elastic drive power transmitting member that transmits drive power from the drive source and absorbs difference in peripheral speed produced between the image transporting belt and the rotary roll.

2. The image forming apparatus according to claim 1, wherein the elastic drive power transmitting member is larger in tensile strain than the image transporting belt.

3. The image forming apparatus according to claim 1, wherein the drive source of the drive section is the same as a drive source that moves circularly the image transporting belt.

4. The image forming apparatus according to claim 3, wherein the elastic drive power transmitting member is driven by a drive roll of the image transporting belt.

5. The image forming apparatus according to claim 4, wherein a tracking portion that performs positioning with respect to the image transporting belt is provided for a part of the rotary roll.

6. The image forming apparatus according to claim 1, wherein the image transporting belt comprises an elastic member.

7. The image forming apparatus according to claim 6, wherein the image transporting belt comes into contact with a drum-shaped image holding member and is arranged along a shape of the image holding member.

8. The image forming apparatus according to claim 1, wherein components of the drive section are incorporated into the sub-unit, and the sub-unit is detachably attached to a image forming apparatus body.

9. The image forming apparatus according to claim 1, wherein the rotary roll of the sub-unit is provided separably from the image transporting belt.

10. The image forming apparatus according to claim 1, wherein components of the drive section are provided separately on a side of an image forming apparatus body and on a side of the sub-unit, and the separated components can be coupled to each other when the sub-unit is attached to the image forming apparatus body.

11. An image forming apparatus comprising:

an image transporting belt that holds an image directly or indirectly and is laid on a plurality of tension rolls to move circularly; and a sub-unit having a rotary roll that comes into contact with the image transporting belt and a drive section for rotationally driving the rotary roll, wherein the drive section includes a drive source, and an elastic drive power transmitting member that transmits drive power from the drive source and absorbs peripheral speed difference produced between the image transporting belt and the rotary roll, and a slip transmission member that engages with the elastic drive power transmitting member and slips under a condition over a peripheral speed difference absorbable range of the elastic drive power transmitting member.

12. The image forming apparatus according to claim 11, wherein the elastic drive power transmitting member is an endless belt having an approximately circular section, and a radius of curvature of a section of a fitting portion of the slip transmission member to the elastic drive power transmitting member is larger than a radius of curvature of a section of the elastic drive power transmitting member.

13. The image forming apparatus according to claim 11, wherein fitting surfaces between the elastic drive power transmitting member and the slip transmission member are approximately plain, and either of them has an uneven shape along a longitudinal direction thereof.

14. The image forming apparatus according to claim 11, wherein the slip transmission member is attached to at least one of the drive source and the rotary roll.

15. The image forming apparatus according to claim 11, wherein the slip transmission member is attached to at least a rotary shaft of the rotary roll, of the drive source and the rotary roll, thereby to rotate integrally with the rotary roll.

16. The image forming apparatus according to claim 11, wherein the slip transmission member is used also as a component member of the rotary roll.

* * * * *